US007261061B2

(12) United States Patent
Shellenberger et al.

(10) Patent No.: US 7,261,061 B2
(45) Date of Patent: Aug. 28, 2007

(54) WATER HEATER WITH LINT COLLECTION DETECTION

(75) Inventors: Timothy J. Shellenberger, Johnson City, TN (US); Thomas A. Edds, Jonesborough, TN (US); Garry D. Statzer, Abingdon, VA (US)

(73) Assignee: American Water Heater Company, Johnson CIty, TN (US)

( * ) Notice: Subject to any disclaimer, the term of this patent is extended or adjusted under 35 U.S.C. 154(b) by 0 days.

(21) Appl. No.: 11/003,749

(22) Filed: Dec. 3, 2004

(65) Prior Publication Data

US 2006/0118063 A1 Jun. 8, 2006

(51) Int. Cl.
*F24H 9/20* (2006.01)

(52) U.S. Cl. ..... 122/14.2; 122/17.1; 122/14.31

(58) Field of Classification Search ..... 122/13.01, 122/14.1, 14.2, 17.1, 14.31; 431/328, 329, 431/278, 280, 281, 2, 6, 12, 18, 22, 32, 61, 431/75, 89

See application file for complete search history.

(56) References Cited

U.S. PATENT DOCUMENTS 3,992,137 A * 11/1976 Streisel ..... 431/278
4,924,816 A * 5/1990 Moore et al. ..... 122/17.1
5,039,300 A 8/1991 Riehl
5,236,327 A * 8/1993 Flanagan et al. ..... 431/12
5,427,525 A 6/1995 Shukla et al.
5,658,139 A 8/1997 Flanagan et al.
6,085,699 A 7/2000 Valcic et al.
6,116,195 A 9/2000 Valcic et al.
6,293,784 B1 * 9/2001 Griffioen ..... 431/343
6,435,140 B1 * 8/2002 Joyce ..... 122/13.01
6,554,608 B1 * 4/2003 Bowman et al. ..... 431/6
6,561,138 B2 5/2003 Kobayashi et al.
6,634,320 B2 * 10/2003 Grando et al. ..... 122/14.2
6,648,627 B2 11/2003 Dane
6,715,451 B2 * 4/2004 Stretch et al. ..... 122/504
6,725,811 B1 * 4/2004 Moore et al. ..... 122/13.01
6,732,677 B2 5/2004 Donnelly et al.
6,755,644 B2 6/2004 Carbone et al.
6,776,125 B2 8/2004 Stretch et al.
6,814,031 B2 11/2004 Stretch et al.
6,901,886 B2 * 6/2005 Lesage ..... 122/14.31
7,028,642 B2 * 4/2006 Peart ..... 122/14.31
2002/0152971 A1 10/2002 Kobayashi et al.
2003/0183177 A1 10/2003 Kobayashi et al.
2003/0188699 A1 10/2003 Valcic et al.
2006/0105281 A1 5/2006 Peart

* cited by examiner

*Primary Examiner*—Gregory Wilson
(74) *Attorney, Agent, or Firm*—DLA Piper US LLP

(57) ABSTRACT

A low $NO_x$ water heater including a water container; a combustion chamber adjacent the water container; and a burner associated with the combustion chamber and arranged to combust fuel to heat water in the water container, the burner comprising a plenum chamber having a combustion surface and a device to detect the presence of the collection of lint, dirt and/or oil.

12 Claims, 8 Drawing Sheets

WATER HEATER WITH LINT COLLECTION DETECTION

FIELD OF THE INVENTION

This invention relates to water heaters and burners used in conjunction with such water heaters. In particular, this invention relates to gas-fired water heaters, burners for such water heaters and lint detection systems used in conjunction with such burners.

BACKGROUND

Reducing polluting emissions from gas-fired water heaters, such as $NO_x$ emissions, continues to be an important objective. Governmental regulations in connection with $NO_x$ emissions continue to become more stringent and it has been a longstanding objective in the industry to continue to reduce $NO_x$ emissions to the point of ultra-low $NO_x$ emissions, such as 10 Ng/J or even less.

Water heater manufacturers have, over the years, attempted to reduce $NO_x$ emissions through a variety of approaches, one approach utilizing radiant screen-type burners. One example is the radiant screen-type burner disclosed in U.S. Pat. No. 5,317,992. However, there have been a series of problems associated with simultaneously achieving: 1) the low $NO_x$ goal, 2) providing a burner that is resistant to build up of lint, dirt, oils and the like or that can shut itself off when too much of a build-up occurs, 3) being able to manufacture a gas-fired water heater in an economical fashion and 4) to produce a water heater that is safe, has excellent longevity and is noise free upon either initial ignition of the burner or during continued combustion on the burner. To date, such efforts have not been completely successful.

SUMMARY OF THE INVENTION

This invention is directed to a water heater including a water container, a combustion chamber adjacent the water container, a burner associated with the combustion chamber and arranged to combust fuel to heat water in said water container, said burner having a combustion surface and adapted to receive fuel, a pilot burner that produces heat positioned adjacent the combustion surface; and means for collecting contaminants from fuel and/or air flowing to the pilot burner such that collection of a selected amount of the contaminants reduces the flow of the air and/or fuel, thereby reducing production of the heat and shutting off the burner by dropping out the thermocouple or thermopile.

This invention is also directed to a water heater including a water container, a combustion chamber adjacent the water container, a burner associated with the combustion chamber and arranged to combust fuel to heat water in the water container, the burner having a combustion surface and adapted to receive fuel, and a device that collects contaminants from fuel and/or air flowing to the pilot burner such that collection of a selected amount of the contaminants reduces the flow of the air and/or fuel, thereby reducing production of the heat and shutting off the burner by dropping out the thermocouple or thermopile.

This invention relates to a water heater including a water container, a combustion chamber adjacent the water container, a burner associated with the combustion chamber and arranged to combust fuel to heat water in the water container, the burner including a plenum chamber having a combustion surface and a fuel/air connection extending from the plenum and adapted to receive fuel and air, a pilot burner positioned adjacent the combustion surface, and an air supply line extending between the fuel/air conduit and the pilot burner.

This invention also relates to a water heater including a water container, a combustion chamber adjacent the water container, a burner associated with the combustion chamber and arranged to combust fuel to heat water in the water container, the burner including a plenum chamber having a combustion surface and a fuel/air conduit extending from the plenum and adapted to receive fuel and air, and a pilot burner positioned adjacent the combustion surface and at an angle that is between about 30° and about 60° out of vertical.

This invention further relates to a water heater including a water container, a combustion chamber adjacent the water container, a burner associated with the combustion chamber and arranged to combust fuel to heat water in the container, the burner including a plenum chamber having a combustion surface and a fuel/air conduit extending from the plenum and adapted to receive fuel and air, a pilot burner including an inner elongated sheath having opposed end portions, an outer elongated sheath concentrically positioned around the inner sheath and having opposed end portions, wherein one of the opposed end portions of the outer sheath has a plurality of openings sized and shaped to admit combustion air into the outer sheath, and a ring-shaped member sealingly positioned in a space formed between the inner and outer sheath.

This invention still further relates to a low $NO_x$ water heater burner system including a plenum chamber having a porous combustion surface, a pilot burner positioned adjacent the combustion surface, a fuel/air supply conduit opening into the plenum chamber, and an air supply line extending between the fuel/air supply line and the pilot burner.

This invention further also relates to a low $NO_x$ water heater burner system including a plenum chamber having a combustion surface, a fuel/air conduit extending from the plenum and adapted to receive fuel and air, and a pilot burner positioned adjacent the combustion surface and at an angle that is between about 30° and about 60° out of vertical.

This invention further still relates to a low $NO_x$ water heater burner system including a plenum chamber having a combustion surface and a fuel/air conduit extending from the plenum and adapted to receive fuel and air, a pilot burner including an inner elongated sheath having opposed end portions, an outer elongated sheath concentrically positioned around the inner sheath and having opposed end portions, wherein one of the opposed end portions of the outer sheath has a plurality of openings sized and shaped to admit combustion air into the outer sheath, and a ring-shaped member sealingly positioned in a space formed between the inner and outer sheath.

DETAILED DESCRIPTION

Figure 1:
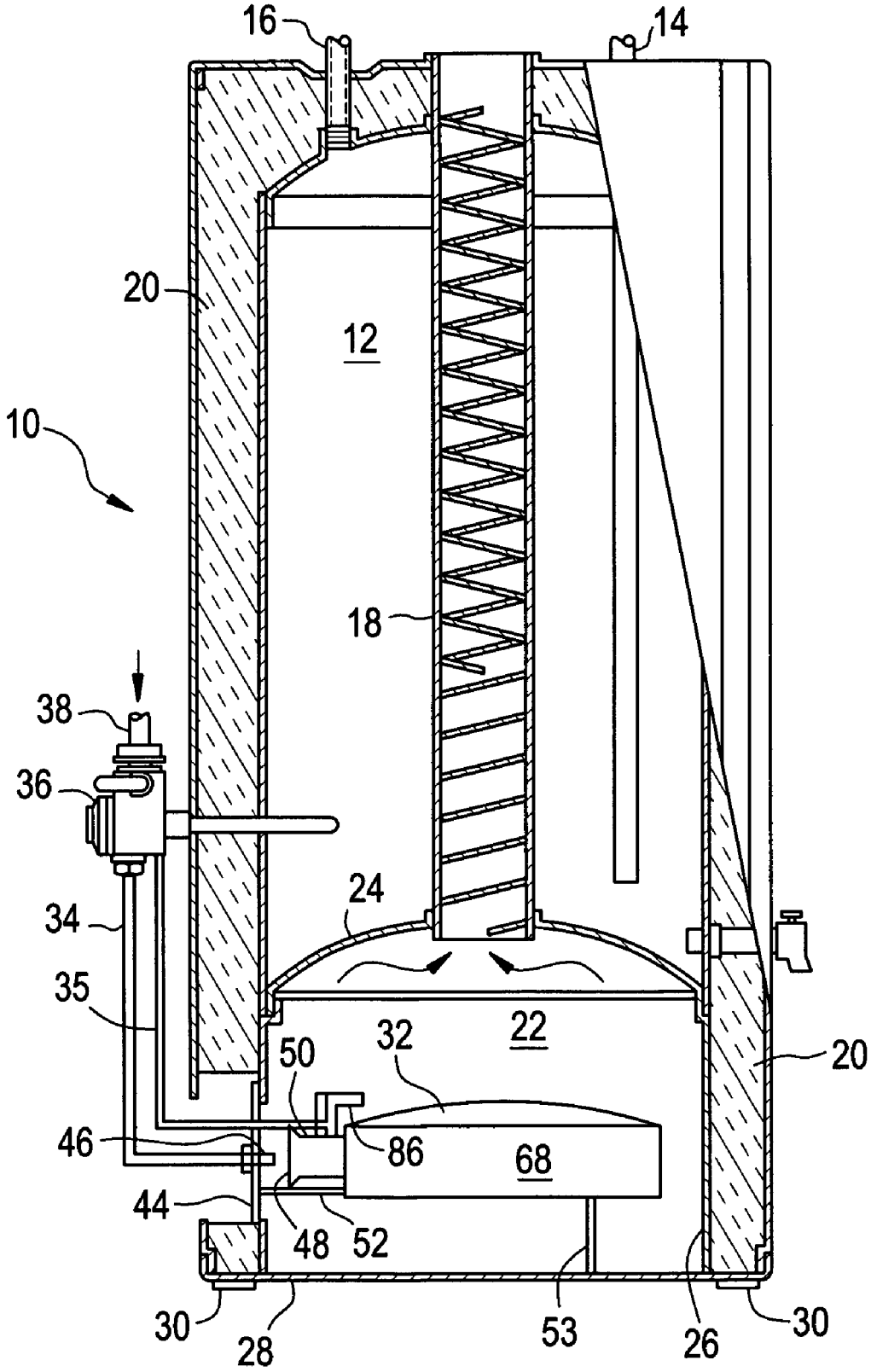
FIG. 1 is a schematic partial sectional view of a water heater in accordance with aspects of the invention which emphasizes certain features of the water heater and omits others for ease of understanding.

It will be appreciated that the following description is intended to refer to specific embodiments of the invention selected for illustration in the drawings and is not intended to define or limit the invention, other than in the appended claims.

Figure 2:
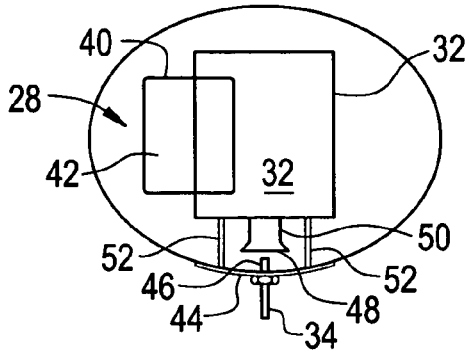
FIG. 2 is a schematic top plan view of a combustion chamber of the water heater shown in FIG. 1.

Turning now to the drawings generally and FIGS. 1 and 2, in particular, one aspect of the invention is disclosed. A water heater 10 includes a water tank/container 12 having a water inlet 14 and a water outlet 16. A flue 18 extends upwardly through the tank and outwardly from the top of water heater 10. Tank 12 is surrounded by insulation 20. Such insulation may be made from any number of foam type insulations well known in the art and/or fiberglass insulation such as around the lower portion of the water heater. Various substitutions may be made without varying from the fundamental spirit of the invention.

A combustion chamber 22 is located below tank 12 and is formed by tank bottom 24, skirt 26 and bottom pan 28. Bottom pan 28 sits on legs 30. A burner 32 formed from a plenum 68 is positioned in combustion chamber 22. Burner 32 is also positioned to receive fuel from fuel line 34, which connects to gas valve 36, which connects to a fuel supply line 38 connected to a fuel supply that is not shown.

Burner 32 is positioned within combustion chamber 22 and above an opening 40 in bottom pan 28. Burner 32 is a so-called "low $NO_x$" burner which is more specifically shown in FIGS. 6 and described later herein in detail. It is, however possible, in accordance with aspects of this invention to utilize any other type of burner that combusts gas (either natural gas, propane or the like) or oil or other fuel. Many other types of burners are well known in the art and need not be discussed herein.

Opening 40 may be covered with an air inlet/flame trap such as an air inlet/flame trap 42 of the type as disclosed in any of U.S. Pat. Nos. 5,797,355, 6,142,106 and 6,085,699, for example. Combustion air enters combustion chamber 22 by opening 40 and flame trap 42 (when present). Although FIG. 2 shows water heater 10 having an opening 40, optionally covered by flame trap 42, it is possible to construct the water heater without an opening 40 such that combustion air enters combustion chamber 22 from another location such as through door 44 or through skirt 26.

Fuel line 34 connects to and extends through door 44 such that the end 46 of fuel line 34 is proximate an exterior end 48 of a venturi 50. Fuel exits end 46 and flows directly into exterior end 48. Although FIGS. 1 and 2 show a venturi 50, any number of fuel/air supply lines may be utilized such as tubes, pipes, pathways, conduits and other structures capable of channeling fuel and air to burner 32. Burner 32 may be connected directly to door 44 by a pair of connectors 52 and held above pan 28 by support 53. Alternatively, connectors 52 may be connected to skirt 26, pan 28 or elsewhere. Pilot fuel line 35 extends between gas valve 36 and pilot burner 86 (partially shown in FIG. 1).

As shown in FIGS. 1 and 2, if venturi 50 is fully positioned within combustion chamber 22, it draws the air it needs to sustain complete combustion entirely through opening 40/flame trap 42. This structure offers several advantages: no dust or varmint cover is needed; if burner 32 flashes back, flames will be contained inside combustion chamber 22, reducing the potential fire hazard; and burner 32 will not be directly involved in a flammable vapor event.

Figure 3:
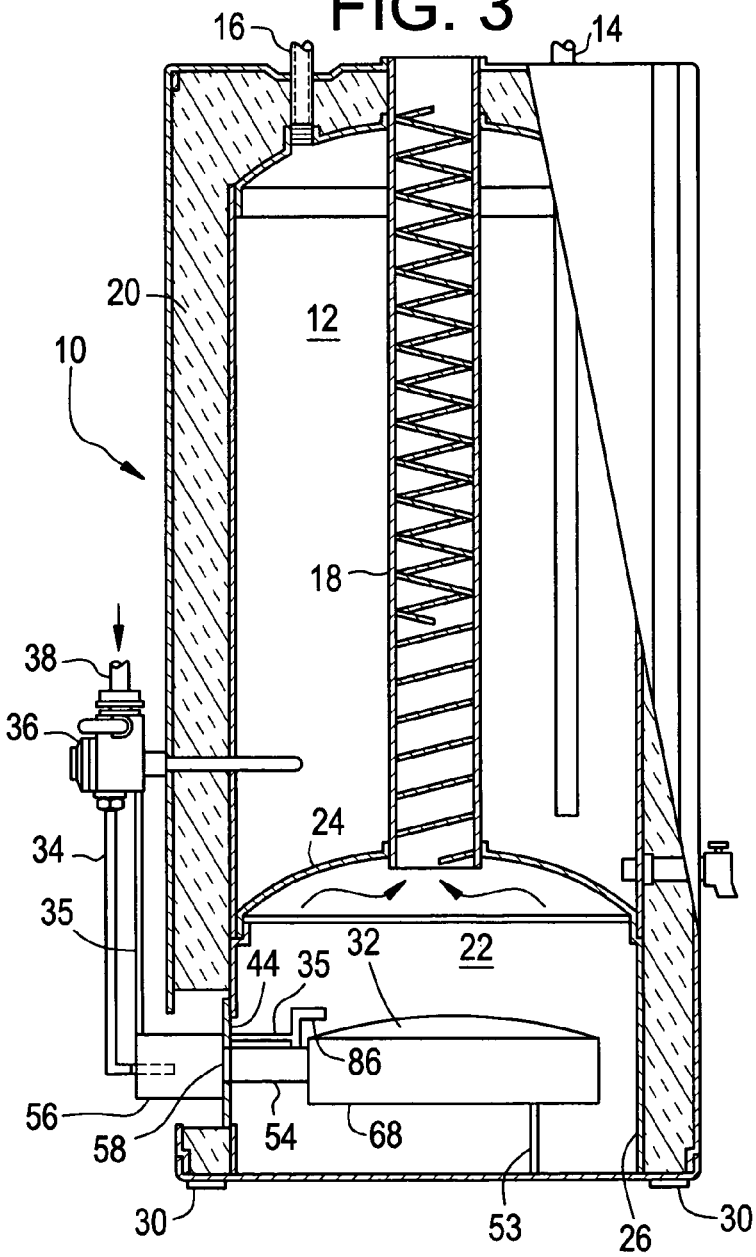
FIG. 3 is a schematic partial sectional view of a water heater in accordance with another aspect of the invention which emphasizes certain features of the water heater and omits others for ease of understanding.
Figure 4:
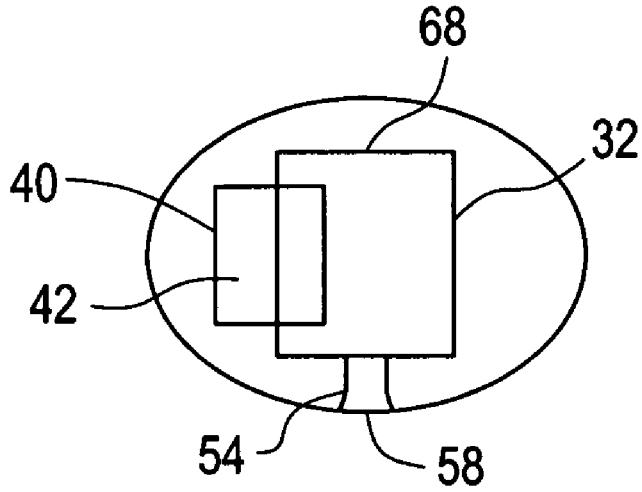
FIG. 4 is a schematic top plan view of a combustion chamber of the water heater shown in FIG. 3.

The embodiment shown in FIGS. 3 and 4 is somewhat similar to FIG. 1 except that burner 32 has a venturi or fuel/air supply line 54 that connects directly between plenum 68 and door 44. Venturi 54 is substantially airtightly sealed to door 44. Although FIG. 4 shows water heater 10 having an opening 40, optionally covered by flame trap 42, it is possible to construct the water heater without an opening 40 such that combustion air enters combustion chamber 22 from another location such as through door 44 or through skirt 26.

A cover also connects to door 44 and serves several purposes. The cover holds fuel line 34 in a desired position with respect to the open end 58 of venturi 54 so that fuel is directed in a desired location through open end 58 and within venturi 54. The top of the cover may be solid to prevent dust and other air borne particulate from entering burner 32. The sides and bottom may be perforated, enclosed in screen, or louvered to prevent the entry of rodents and large insects from entering and clogging venturi 54. Interchangeable orifices can be mounted in the front part of the cover and provides the desired orifice to venturi alignment Support 53 holds burner 32 in a desired position above pan 28.

In operation, the burner 32 operates under the fundamental condition that fuel is supplied to the venturi 50/54 and combustion air is mixed at the inlet portion of the venturi 50/54 and the mixed fuel flows into plenum 68 and may further be mixed and distributed by virtue of some type of diffuser as desired. The air and fuel mixture is then combusted along the surface of screen 70 in the usual manner.

Depending on the construction of the water heater itself, there are slight variations in the manner in which burner 32 operates. For example, in the embodiment shown in FIGS. 1 and 2, primary combustion air is introduced into combustion chamber 22 by way of opening 40, which may or may not be covered with a flame trap 42. Also, some secondary combustion air can flow upwardly to screen 70 directly from opening 40.

On the other hand, in the embodiment shown in FIGS. 3 and 4, primary combustion air is introduced solely through venturi 54 and opening 58. Depending on the construction of combustion chamber 22, secondary air may flow through an opening 40 if present. Otherwise, combustion air flows through opening 58 and into venturi 54.

Figure 5:
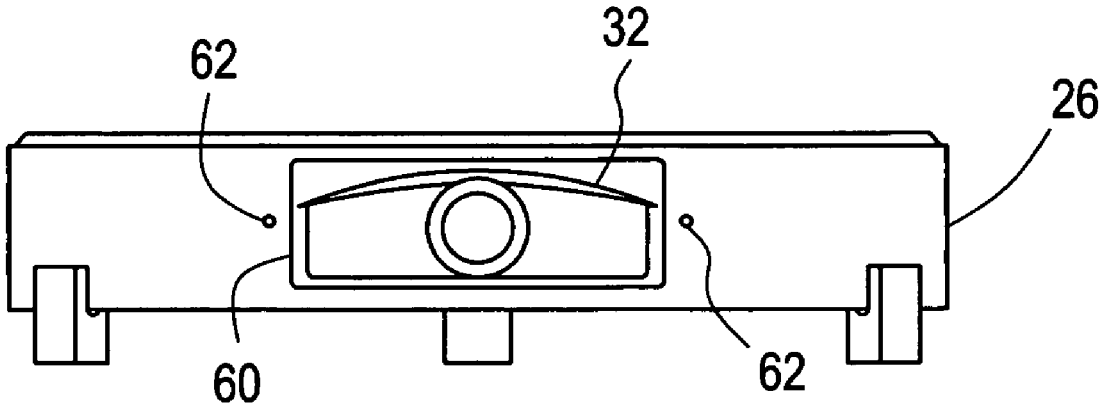
FIG. 5 is a front elevational view of a combustion chamber and burner in accordance with aspects of the invention.

FIG. 5 shows burner 32 in a preferred position relative to skirt 26 and opening 60 in skirt 26. Burner 32 is sized and shaped to be removable from combustion chamber 22 through opening 60. Burner 32 is preferably rectangular in shape and sized slightly smaller than opening 60. Door 44 (not shown in FIG. 5) is removably sealed to skirt 26, typically by screws (not shown) which extend through holes 62 in skirt 26.

Figure 6:
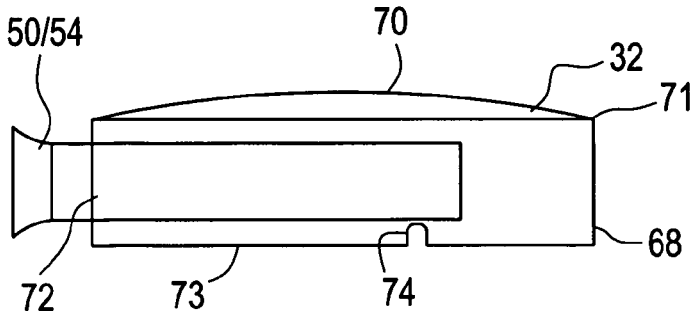
FIG. 6 is a schematic side view of portions of a burner in accordance with aspects of the invention.

FIG. 6 shows portions of burner 32, including rectangularly-shaped plenum 68 having a substantially flat or planar bottom 73. Burner 32 has a combustion surface 70 which is most preferably in a curved configuration although any shape, including flat or substantially flat, is possible. The surface is porous and preferably Inconel® screen, most preferably having portions of the screen formed into reinforcing ribs. Irrespective of the shape of combustion surface 70, that surface has a plane that generally passes through the surface, that plane being substantially coincident with a plane formed by an upper edge 71 of plenum 68 or parallel to the plane formed by upper edge 71.

As previously noted, burner 32 may have a construction completely different from that shown in the figures and may be a type of burner other than the low $NO_x$ burner 32 illustrated herein. In any event, in essentially all burners suitable for use in connection with liquid or gaseous fuel, such burners have a combustion surface of some type wherein a multiplicity of ports are present on the surface itself or are located at or around the edge of that surface that permit egress of fuel and/or combustion air for formation of a flame adjacent such multiple holes or ports. Those ports/holes are typically arranged in a generally planar manner, typically in a generally horizontal orientation. Nonetheless, such burners may be utilized in accordance with aspect of this invention and fall within the scope of the appended claims.

Plenum 68 has an opening 72 sized and shaped to receive venturi 50/54 in a substantially sealed manner. The length of venturi 50/54 may be adjusted as desired. A small rib 74 may be manufactured into the bottom of plenum 68 to provide an attachment point for the inwardly extending end portion of venturi 50. Connector 53 (shown in FIGS. 1 and 3) may also attach at rib 74.

Two screens, one being a flame holding screen 70 and a second being a non-flame holding screen (not shown), may also be used to even out distribution of the fuel/air mixture and further prevent flash back. In one embodiment, the non-flame holding screen is placed at a slightly greater distance by mounting it on a secondary surface separate from the flame holding screen 70. This improves flash back characteristics due to leaks on the seal on the flame holding screen 70 to the plenum joint at upper edge 71. The second screen is sealed separately and helps to stop a flash back from occurring. Also, this confers the advantage of being able to let the screens expand at different rates without interfering with each other. The non-flame holding screen, operating at a much lower temperature, expands less and, therefore, does not interfere with the flame holding screen 70 which expands at a much higher rate. Such interference is common among two screen burners that attempt to share a common sealed joint.

Figure 7:
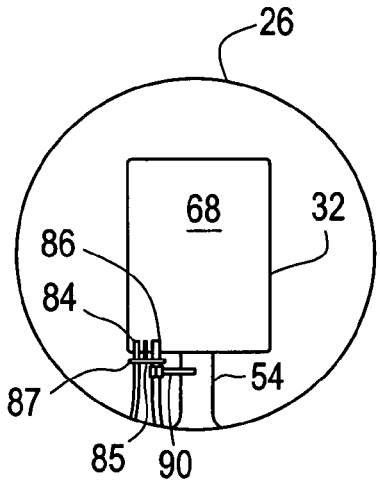
FIG. 7 is a schematic top plan view of a burner and a pilot burner in accordance with the invention positioned within a combustion chamber.
Figure 8:
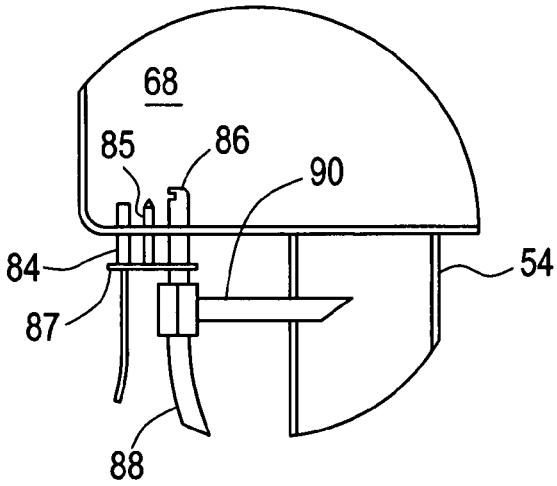
FIG. 8 is a partial exploded view of the burner and pilot burner shown in FIG. 6.

FIGS. 7 and 8 show a thermocouple 84, a piezo igniter 85 and a pilot burner 86 connected to a pilot fuel supply 88. These components are mounted on a pilot mounting bracket 87 and extend over combustion surface 70. Also, an air supply tube 90 connects between venturi 54 and pilot burner 86. It may also connect to pilot fuel supply 88. The air supply 90 supplies fresh air to pilot burner 86 during normal operation. Oftentimes, over time, lint, debris and the like that may be passing through venturi 54 and air supply 90 begins to deprive pilot burner 86 of oxygen or fuel. As this phenomenon progresses, the pilot flame begins to lift off the thermocouple 84. Thermo couple 84 can then no longer produce enough voltage to keep the magnet in gas control value 36 "pulled in" which results in water heater 10 shutting off until cleaning of the air supply 90 is performed. Pilot burner 86, in conjunction with air supply 90, is designed such that water heater 10 shuts off just before CO emissions from burner 32 (or any other type of burner) reaches a certain desired level such as 400 ppm at 0% oxygen, for example due to containments that may have built up on combustion surface 70 of burner 32.

Figure 9:
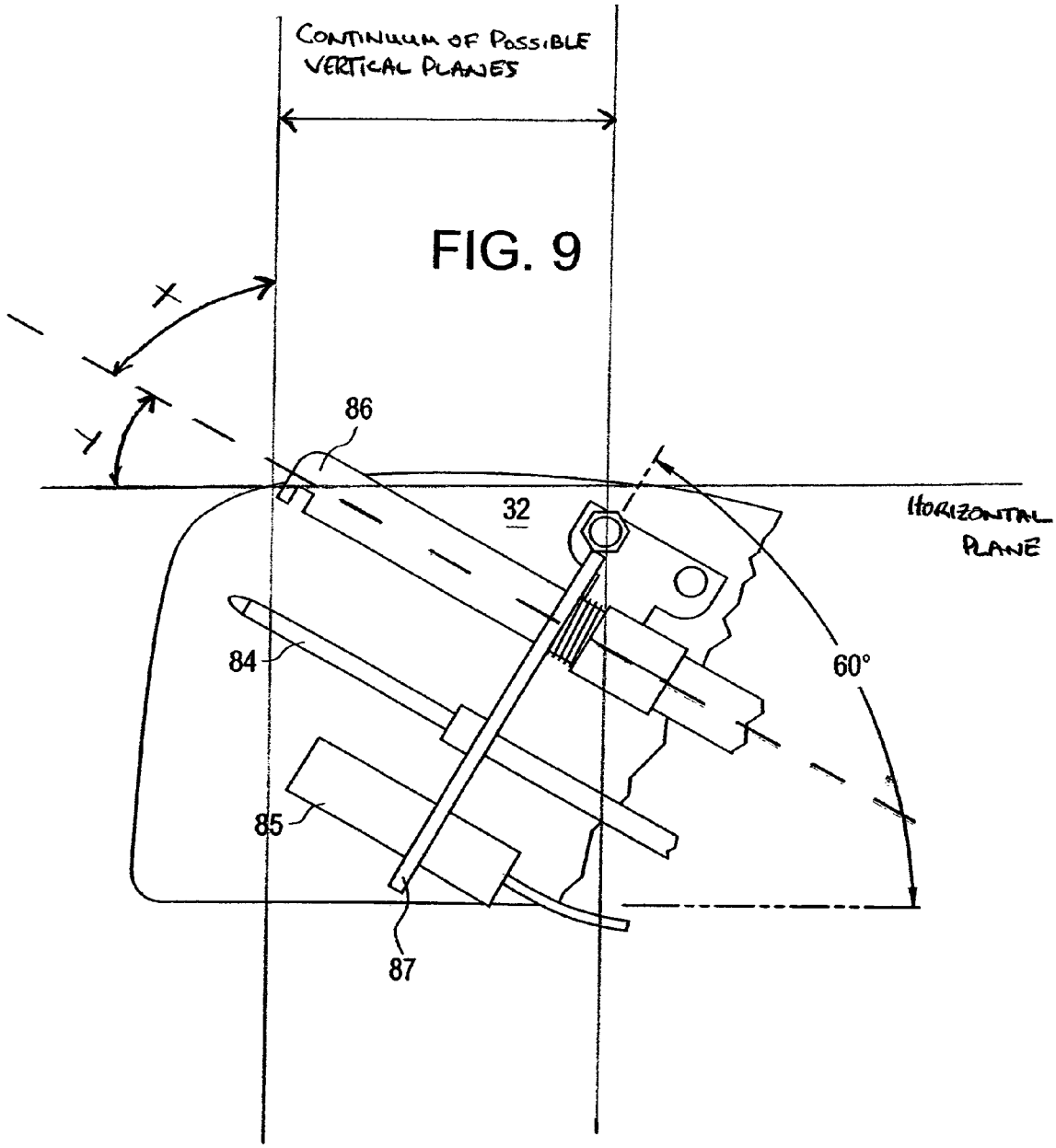
FIG. 9 is a partial exploded front elevational view of a burner and a pilot burner in accordance with aspects of the invention.
Figure 10:
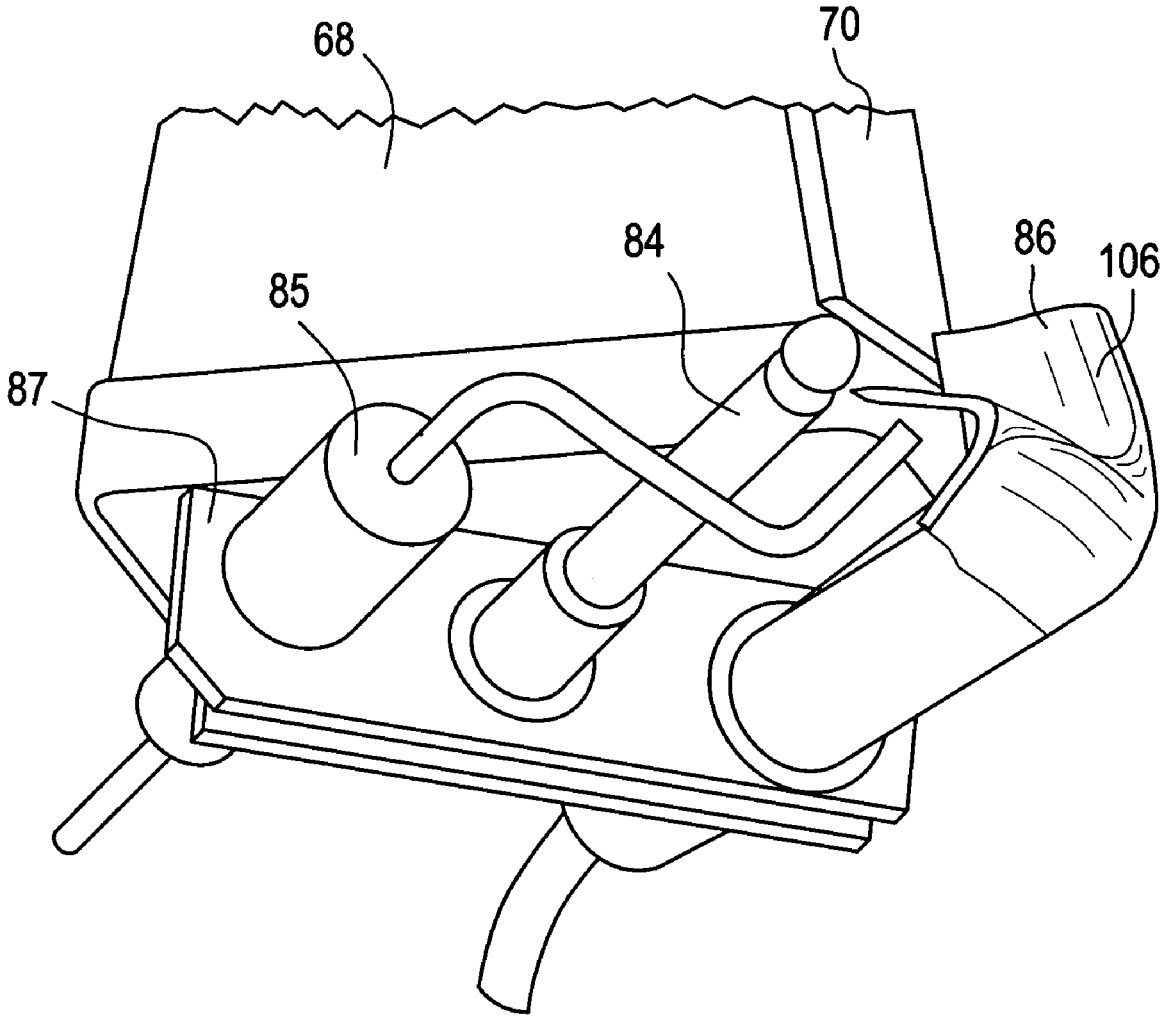
FIG. 10 is a partial exploded perspective view of a burner and a pilot burner in accordance with aspects of the invention.

FIG. 9-10 show another aspect of the invention wherein pilot burner 86, thermocouple 84 and piezo igniter 85, all mounted on pilot burner bracket 87, are attached to plenum 68 at an angle to the bottom 73 of plenum 68. Thus, an angle drawn between the plane of bottom 73 of plenum 68 and the plane of burner bracket 87 should be between about 30° and about 60°. Preferably, the angle should be about 60°. Said differently, pilot burner 86, having an axis extending longitudinally therethrough, should have the axis oriented at an angle of about 30° to about 60° out of vertical. Again, that angle should preferably be about 60°. In referring to the plane extending through combustion surface 70, it should be noted that combustion surface 70 may be planar or may be curved or in some kind of other configuration. However, combustion surface 70 has a "general" plane that is substantially parallel to either top edge 71 of plenum 68 or bottom 73 of the plenum 68. That plane may be coincident with upper edge 71 of plenum 68 or slightly above, but parallel to it. In any event, the angle of the axis extending through pilot burner 86 should be between the angles specified above.

We have discovered that, by orienting pilot burner 86 in the range of angles specified above, pilot burner 86 provides better flame control to thermocouple 84, thereby improving its utility and service life. We also found that the improvement is limited to the range of about 30 to about 60°. Too shallow of an angle (less than about 30°) provides no improvement and too steep of an angle (more than about 60°) causes difficulties lighting and maintaining a pilot flame adjacent to the thermocouple 84. Another reason for the range of about 30 to about 60° is due to the well known fact that the pilot flame tends to rise upwardly and, as pilot burner 86 becomes plugged or clogged with lint, debris, oil and the like, flame velocity decreases. As a consequence, the "horizontal" velocity of the flame becomes still lower. If the angle of pilot burner 86/thermocouple 84 is within the specified range, the pilot flame will pull off of thermocouple 84 sooner, thereby providing greater sensitivity to differences in the flame output of pilot burner 86 while maintaining the ability of pilot burner 86 to light burner 32.

Figure 11:
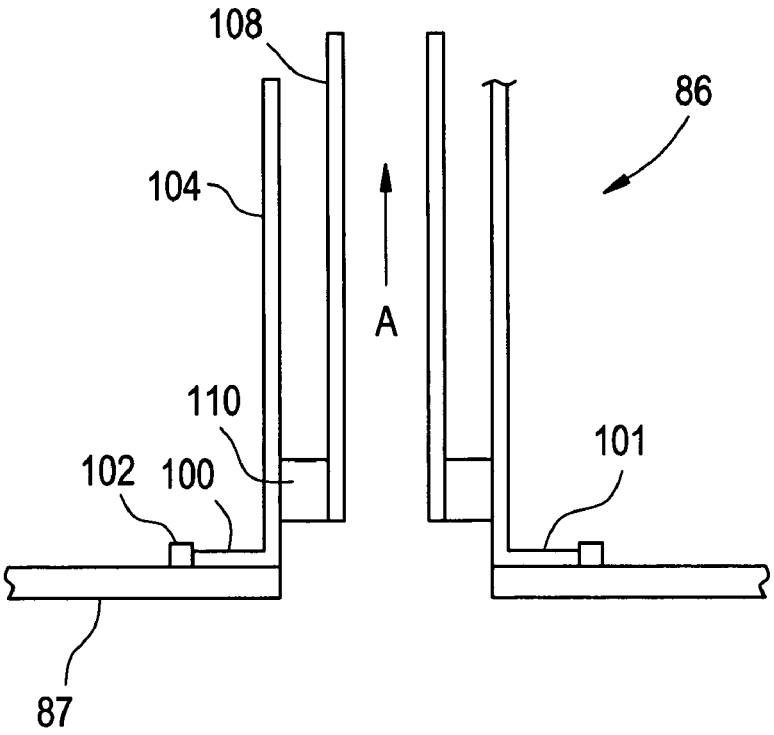
FIG. 11 is a cross-sectional view of a portion of the pilot burner shown in FIG. 9.
Figure 12:
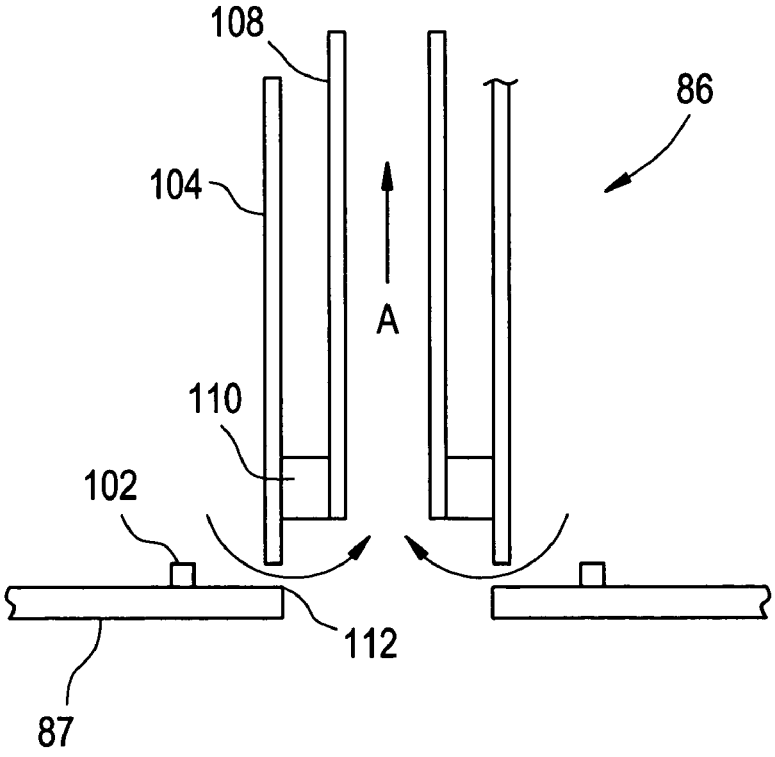
FIG. 12 is a cross-sectional view of the portion of pilot burner of FIG. 11 rotated by about ⅛ of the distance of the circumference of the pilot burner.

FIGS. 11-12 show yet another aspect of the invention wherein pilot burner 86 has a structure that provides for the detection of the collection of lint, dirt and/or oil, sometimes hereinafter referred to as "contaminants," and provides for a shut-down of pilot burner 86 in response thereto. In particular, pilot burner 86 is connected to pilot burner mounting bracket 87 and has a base member 100 having a series of slots cut out of the base 100 so that there are preferably four slots/openings 112 and four substantially equi-sized base portions 101. Base 100 is surrounded by a ring 102. Pilot burner 86 has an outer sheath 104 capped by a hood 106, hood 106 providing an open structure through which fuel and air may exit. Concentrically located within outer sheath 104 is an inner sheath 108. The lower portion of inner sheath 108 is sealed to outer sheath 104 by a seal member 110. A mixture of fuel and gas passes through inner sheath 108 in the direction of the arrow "A".

Figure 13:
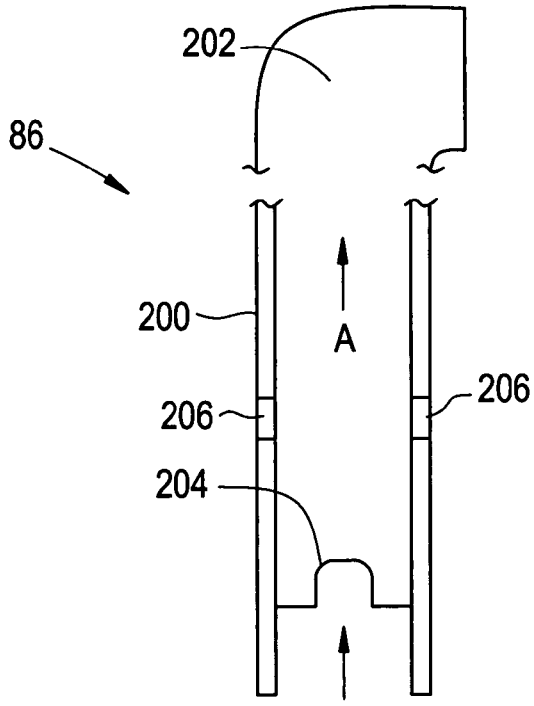
FIG. 13 is a partial cross-sectional view of a pilot burner in accordance with aspects of the invention.
Figure 14:
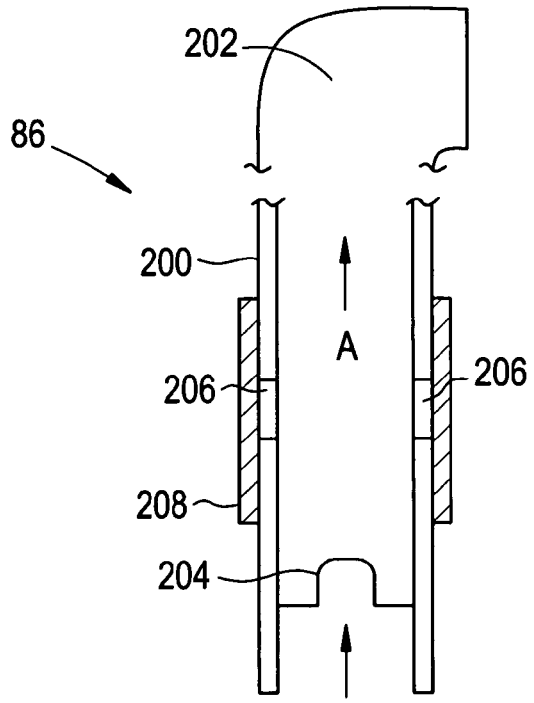
FIG. 14 is a partial cross-sectional view of a pilot burner in accordance with aspects of the invention.

FIG. 14 shows another aspect of a pilot burner 86 that is somewhat similar to pilot burner 86 of FIG. 13. However, pilot burner 86 of FIG. 14 has an additional screen that surrounds a portion of sheath 200 and covers openings 206. Openings 206 and screen 208 are sized and shaped to detect and collect contaminants over the course of time and, preferably at a rate that is similar to the rate of collection of contaminants on combustion surface 70, but ultimately will result in the extinguishment of the flame generated by pilot burner 86, thereby resulting in shutting off water heater 10.

As particularly shown in FIG. 12, air is introduced through the slots/openings 112 in base 100 (shown specifically in FIG. 11). This is one portion of pilot burner 86 that acts as a detection mechanism for excessive accumulation of lint, dirt and/or oils. The slots/openings 112 may begin to be clogged or blocked by an accumulation of lint, debris, oils and the like over time and such blocking starves pilot burner 86 of oxygen to support combustion whereby pilot burner 86 is shut off. This results in the same shutting down action as described above with respect to air supply tube 90 as described in conjunction with FIGS. 7 and 8, for example.

The slots/openings 112 do not alone perform this task. The presence of seal member 110 in the space between inner sheath 108 and outer sheath 104, to our surprise, cause this blocking/clogging phenomenon to occur at the slots/openings 112. We also discovered that it is possible to employ a pilot burner 86 that does not contain seal member 110. However, in such a case, some type of blocking facilitation material should be placed over the slots/openings 112. Such materials can be made from any number of sources such as screening to cover such slots/openings 112 or, alternately, some type of packing material such as steel wool, for example, or screening in the location of seal member 110.

FIG. 13 is another embodiment of a possible pilot burner 86 that may be utilized in accordance with aspects of the invention. Pilot burner 86 in this configuration has an outer sheath 200 with a hood 202 on one end and an opening 204 sized and shaped to receive pilot burner fuel on the other end. A pair of openings 206 are located in sheath 200 and provide the means for detecting and collecting contaminants such that air is, over the course of time, reduced to the point where the flame generated by pilot burner 86 snuffs out or is reduced in its heat generation capability to cause thermocouple 84 (not shown in FIG. 13) to cause water heater 10 to shut off. Openings 206 are preferably sized and shaped to collect contaminants at a rate similar to the rate of collection of contaminants on combustion surface 70.

Thus, irrespective of the particular construction of pilot burner 86, it is advantageous to provide a means or device that is sized/shaped/calculated to provide for the flow of combustion air and/or fuel to be reduced and substantially blocked, over the course of time due to the collection of contaminants. Also as noted above, it is not important as to the size, shape or type of material chosen to provide the blocking/clogging function. It is preferred that it is substantially calculated to shut down the pilot burner at a time that shuts off water heater 10 just before CO emissions from the burner reaches a specified level. Thus, the device or means utilized to cause the above described plugging or clogging or blocking may be utilized in conjunction with a pilot burner design that clogs/plugs/blocks at approximately the same rate that collection of lint, debris, oils and the like would likely diminish the flame characteristics of the main burner such that CO would be produced at a level that would be advantageous to shut off the water heater. Of course, those of ordinary skill in the art can readily make such determinations with little, if any, experimentation.

It is also preferred to mount the end of the venturi tube 50/54 into the bottom floor of plenum 68 at rib 74 to reduce stress on the joint where venturi 50/54 passes through end wall 100. This joint is susceptible to leakage and, having a stress loading under high thermal conditions, causes problems to arise with this type construction. By securing the end of venturi 50/54 by means of a weld, rivet or screw at rib 74 the stresses on the joint are reduced.

There are several reasons why a pilot burner 86 that shuts down due to contamination is desirable in a gas-fired water heater:

Safety: If the combustion system operation is impaired in a fashion that produces high levels of CO due to the collection of contaminants on combustion surface 70, a pilot burner 86 that monitors the amount of contamination that may have caused this condition can safely deactivate burner 32 and shut down water heater 10. Water heater 10 requires maintenance to be performed before operation may resume.

Utilization of Low $NO_x$ Burner Technology: Burners that achieve low levels of $NO_x$ emissions may not promote complete combustion of the fuel after they have been contaminated by certain amounts of lint, dirt, oil and the like, creating high levels of CO. A pilot burner 86 specifically designed to work in conjunction with a low $NO_x$ burner 32 can provide both low $NO_x$ and low CO.

Lint, Dirt and Oil Compliance: Many new high efficiency or low emission burner technologies utilize small ports and act effectively as filters. Over time, these burners may become partially plugged by contaminants normally found in homes or commercial areas. A plugged burner may create high levels of CO, which can be safely shut down by means of pilot burner 86 that plugs at approximately the same rate as main burner 32.

Historically, it has been the case that premix radiant burners such as burner 32 as shown in FIGS. 1 and 3 perform best with respect to low $NO_x$ emissions by utilizing 100% primary air. Thus, there are, under those circumstances, no secondary air openings 40 in combustion chamber 22. However, we discovered that by utilizing burner 32 in conjunction with an open flame traps/arrestor, that several surprising phenomenon occurred. We substantially eliminated or reduced sound emissions such as start-up (rumbling) and operational noise (as high as 100+ dB scream). We found that the use of an insulating material (fiberglass or ceramic cloth, for example), sandwiched between the floor of burner 32 and bottom pan 28 of combustion chamber 22, substantially eliminates operational scream. We also found success with a pad (metallic, foam, ceramic or other) placed inside burner 32, lying on the plenum floor; a belt of insulating material with bumps or other geometrical shapes wrapped around the inside of the combustion chamber 22; a formed sheet lying on bottom pan 28 of combustion chamber 22 with bumps, V's or pyramids of a specific shape, was quite effective; and isolating venturi 50/54 and burner 32 from door 44 by using a soft gasket or grommet to suspend burner 32 and isolate the chamber 22 and tank 12 from the vibration produced from such burner 32.

Also, we discovered that we were able to improve ignition characteristics such as smoother lighting of the main burner and no flash back. Further, we discovered that quite surprisingly the presence of secondary air improves burner performance as the burner begins to become covered or plugged with contaminating materials. This phenomenon is sharply different from prior experience.

The utilization of burner 32 in any of the above-described configurations of water heaters provides for reduced $NO_x$ emissions such that the burner system itself and the water heater system taken together produce ultra-low $NO_x$ emissions which meet many of the current and upcoming $NO_x$ emissions regulations set forth by a number of state jurisdictions, such as 10 Ng/j or below.

Although this invention has been described in connection with specific forms thereof, it will be appreciated that a wide variety of equivalents may be substituted for the specified elements described herein without departing from the spirit and scope of this invention as described in the appended claims.

What is claimed is:

1. A water heater comprising:

a water container;

a combustion chamber adjacent the water container;

a main burner associated with the combustion chamber and arranged to combust fuel to heat water in said water container, said burner comprising a plenum chamber having a combustion surface and a fuel/air conduit extending from the plenum chamber adapted to receive fuel and air;

a pilot burner that receives fuel directly from a fuel conduit and produces heat positioned adjacent the combustion surface; and means for collecting contaminants from fuel and/or air flowing to the pilot burner such that collection of a selected amount of the contaminants reduces the flow of the air and/or fuel, thereby reducing production of the heat and shutting off the main burner;

wherein the flow of the fuel and/or air to the pilot burner is at a rate that substantially corresponds to a rate of collection of contaminants on the combustion surface that results in production of CO by the main burner at a selected level.

2. A water heater comprising:

a water container;

a combustion chamber adjacent the water container;

a main burner associated with the combustion chamber and arranged to combust fuel to heat water in the water container, the main burner comprising a plenum chamber having a combustion surface and a fuel/air conduit extending from the plenum chamber and adapted to receive fuel and air;

a pilot burner that receives fuel directly from a fuel conduit and produces heat positioned adjacent the combustion surface; and an opening in the pilot burner that collects contaminants from fuel and/or air flowing to the pilot burner and the main burner such that collection of a selected amount of the contaminants reduces the flow of the air and/or fuel, thereby reducing production of the heat and shutting off the burner.

3. The water heater defined in claim 2, wherein the opening in the pilot burner is covered by a screen.

4. A water heater comprising:

a water container;

a combustion chamber adjacent the water container;

a main burner associated with the combustion chamber and arranged to combust fuel to heat water in the water container, the main burner comprising a plenum chamber having a combustion surface and a fuel/air conduit extending from the plenum chamber and adapted to receive fuel and air;

a pilot burner that receives fuel directly from a fuel conduit and produces heat positioned adjacent the combustion surface; and a device that collects contaminants from fuel and/or air flowing to the pilot burner and the main burner such that collection of a selected amount of the contaminants reduces the flow of the air and/or fuel, thereby reducing production of the heat and shutting off the burner;

wherein the flow of the fuel and/or air to the pilot burner is at a rate that substantially corresponds to a rate of collection of contaminants on the combustion surface that results in production of CO by the main burner at a selected level.

5. The water heater defined in claim 4, wherein the opening in the pilot burner is covered by a screen.

6. A water heater comprising:

a water container;

a combustion chamber adjacent the water container;

a main burner associated with the combustion chamber and arranged to combust fuel to heat water in the water container, the main burner having a combustion surface and adapted to receive primary combustion air through an opening not covered by a flame trap/arrestor;

a pilot burner that receives fuel directly from a fuel conduit and produces heat positioned adjacent the combustion surface; and a device that collects contaminants from fuel and/or air flowing to the pilot burner such that collection of a selected amount of the contaminant reduces the flow of the air and/or fuel, thereby reducing production of the heat and shutting off the main burner.

7. The water heater defined in claim 6, wherein the main burner is a low NOx burner.

8. The water heater defined in claim 6, further comprising a thermocouple and an igniter positioned adjacent the pilot burner.

9. The water heater defined in claim 6, wherein the pilot burner comprises an inner elongated sheath having opposed end portions, an outer elongated sheath concentrically positioned around the inner sheath and having opposed end portions, wherein one of the opposed end portions has a plurality of openings sized and shaped to admit combustion air into the outer sheath, and the device comprises a member sealingly positioned in a space formed between the inner and outer sheath.

10. The water heater defined in claim 6, wherein the device is an opening in the pilot burner.

11. The water heater defined in claim 6, which emits 10 Ng/j or less of NOx.

12. A water heater, which emits 10 Ng/j or less of NOx, comprising:

a water container;

a combustion chamber adjacent the water container;

a main burner associated with the combustion chamber and arranged to combust fuel to heat water in said water container, said main burner having a combustion surface and adapted to receive primary combustion air through an opening not covered by a flame trap/arrestor;

a pilot burner that receives fuel directly from a fuel conduit and produces heat positioned adjacent the combustion surface; and means for collecting contaminants from fuel and/or air flowing to the pilot burner such that collection of a selected amount of the contaminants reduces the flow of the air and/or fuel, thereby reducing production of the heat and shutting off the main burner.

* * * * *